US007021302B2

(12) United States Patent
Neumaster et al.

(10) Patent No.: US 7,021,302 B2
(45) Date of Patent: Apr. 4, 2006

(54) ACTIVE FEED PAINTBALL LOADER WITH FLEXIBLE IMPELLER

(75) Inventors: Terry Neumaster, Bentonville, AR (US); Bruce Crites, Kalamazoo, MI (US); Michael Jezdimir, Plainwell, MI (US)

(73) Assignee: Brass Eagle LLC, Bentonville, AR (US)

( * ) Notice: Subject to any disclaimer, the term of this patent is extended or adjusted under 35 U.S.C. 154(b) by 0 days.

(21) Appl. No.: 10/650,075

(22) Filed: Aug. 28, 2003

(65) Prior Publication Data

US 2004/0074489 A1 Apr. 22, 2004

Related U.S. Application Data

(60) Provisional application No. 60/407,007, filed on Aug. 30, 2002.

(51) Int. Cl.
*F41B 11/02* (2006.01)

(52) U.S. Cl. ..... 124/48; 124/49; 124/51.1

(58) Field of Classification Search ..... 124/48, 124/49, 51.1; 221/200, 203, 258, 277
See application file for complete search history.

(56) References Cited

U.S. PATENT DOCUMENTS 3,059,629 A * 10/1962 Stinson ..... 124/23.1
4,265,739 A * 5/1981 Dalton ..... 209/169
4,697,721 A * 10/1987 Johnson et al. ..... 221/211
4,759,435 A * 7/1988 Cedrone ..... 198/459.8
5,282,454 A 2/1994 Bell et al.
5,799,598 A * 9/1998 Stufflebeam et al. ..... 111/185
5,816,232 A 10/1998 Bell
6,213,110 B1 4/2001 Christopher et al.
6,305,367 B1 10/2001 Kotsiopoulos et al.
6,415,781 B1 7/2002 Perrone
6,467,473 B1 10/2002 Kostiopoulos
6,488,019 B1 12/2002 Kotsiopoulos
6,502,567 B1 * 1/2003 Christopher et al. ..... 124/51.1
6,761,158 B1 * 7/2004 Wright ..... 124/92
2002/0014230 A1 2/2002 Christopher et al.
2002/0092513 A1 7/2002 Christopher et al.
2003/0010330 A1 1/2003 Jong

OTHER PUBLICATIONS

Bill Mills, WARPIG—World and Regional Paintball Information Guide, "eVLution 2 Sneak Preview", Aug. 2001, pp. 1-4.

* cited by examiner

*Primary Examiner*—John A. Ricci
(74) *Attorney, Agent, or Firm*—Foley & Lardner LLP

(57) ABSTRACT

An impeller for an active-feed paintball loader has resilient arms that engage paintballs in the lower portion (well) of the loader and advance them to and through the outfeed tube. The resilient arms are sufficiently stiff to move unobstructed paintballs located between the arms, and sufficiently flexible to yield when forced against stationary paintballs so as not to rupture the paintball shells, the arms substantially returning to their original shape when the obstruction is removed. Accordingly, when the motor is shut off, the arms will simply flex backward as they encounter stationary paintballs. Should a paintball jam occur in the vicinity of the impeller, the arm(s) can flex around the jammed ball without breaking it, and help to dislodge it so as to clear the jam.

52 Claims, 7 Drawing Sheets

ACTIVE FEED PAINTBALL LOADER WITH FLEXIBLE IMPELLER

CROSS REFERENCE TO THE RELATED APPLICATION

This application claims the benefit of U.S. provisional application Ser. No. 60/407,007, filed Aug. 30, 2002.

BACKGROUND OF THE INVENTION

1. Field of the Invention

The invention relates to loaders for paintball guns. More particularly, the invention relates to a paintball loader having a motor-driven impeller for actively feeding paintballs to the infeed opening of a paintball gun.

2. Description of the Related Art

The game of paintball has enjoyed great success in recent years. In the game, each of two or more teams tries to capture the opposing team's flag. The players on the teams carry a compressed air-powered gun that shoots paintballs (i.e., gelatin-covered spherical capsules which contain a colored liquid) a considerable distance. When a player is hit with a paintball fired from a gun, the paintball ruptures and leaves a colored mark on the hit player; the hit player must leave the game. As the game of paintball has grown in sophistication, semi-automatic paintball guns (i.e., guns that sequentially fire individual paintballs as fast as the trigger can be repeatedly pulled) have become more prevalent. The high firing rate capability of semi-automatic paintball guns has necessitated the use of bulk paintball loaders in conjunction with such guns.

A conventional bulk paintball loader typically comprises a housing positioned above and slightly to one side of the paintball gun. The housing is adapted to internally store a relatively large number of paintballs and has a bottom outlet opening through which the stored paintballs can sequentially drop. Connected to the housing's bottom outlet opening, and extending downwardly therefrom, is an outfeed tube that is connectable to the paintball gun's hollow infeed tube.

During normal operation of the loader, paintballs dropped through the bottom outlet opening of the housing form a paintball stack within the outfeed tube and gun infeed tube. When the paintball at the bottom of the stack is dropped into the firing chamber of the paintball gun, it is replaced, at the top of the stack, from the supply of paintballs remaining in the loader housing, thereby replenishing the stack. In replenishing the stack of paintballs, however, jams sometimes occur within the loader housing, above its bottom outlet opening. Paintball jams of this nature prevent normal gravity-fed delivery of paintballs downwardly through the bottom outlet opening, with the result that the paintball stack can be totally depleted after several shots of the paintball gun.

One solution for clearing paintball jams involves forcibly shaking the paintball gun and attached loader to dislodge the paintballs that are causing the jam within the loader housing. This solution has proved undesirable as it interrupted the proper aiming of the paintball gun and correspondingly interrupted the paintball gun user's ability to shoot the paintballs continuously and rapidly.

Another solution is presented in U.S. Pat. No. 5,282,454, which is incorporated herein by reference. The '454 patent incorporates a jam clearing system into the paintball loader device. The jam clearing system includes an agitator disposed within the housing near the outlet, and an optical circuit for detecting the absence of paintballs at a specified location within the outfeed tube (i.e., a depleted stack). Upon detection of the absence of a paintball at the specified location within the outfeed tube, the optical circuit would close a switch to turn on a stepper motor, which would cause the agitator to rotate. Agitator rotation usually would eliminate the paintball jam within the loader, allowing paintballs to resume gravity feed into the outfeed tube. This, in turn, would replenish the paintball stack and cause the optical circuit to open the switch and turn off the motor, thus arresting the agitator. While improving delivery of paintballs to the paintball gun, the agitator solution of the '454 patent is not optimal because the agitator simply shuffles paintballs within the loader housing, which are fed only by gravity to the outfeed tube.

Yet another solution for clearing paintball jams is presented in U.S. Pat. No. 5,816,232, which is also incorporated herein by reference. In the "active feed" loader of the '232 patent, a switch controlling a motor-driven impeller is turned on and off by an optical paintball detector in a manner similar to the agitator control in the '454 patent. The impeller of the '232 patent is situated in a surrounding well at the bottom of the loader housing and has curved arms that sequentially move paintballs one-by-one toward the outfeed tube. Similar active-feed paintball loaders are disclosed in U.S. Pat. No. 6,213,110 and U.S. Patent Publication No. US 2002/0014230 A1. In all of these active-feed loaders the impeller is made of a relatively stiff, unyielding material. If the impeller should turn when there is a paintball jam, or when the stack of paintballs in the outfeed tube is static (gun not firing), the stiff impeller can squeeze and undesirably break one or more paintballs in the loader housing. This latter situation can occur if the motor does not shut off due to a malfunction, or during normal operation if motor/impeller rotation is not arrested quickly enough. U.S. Patent Publication No. US 2002/0092513 A1 recognizes this impeller over-running problem, but the solution proposed is a complex and seemingly costly spring mechanism built into the impeller.

A need therefore exists for a simple and economical active-feed paintball loader that reliably feeds paintballs to the outfeed tube to ensure a rapid and steady supply of paintballs to the gun, while preventing (or at least greatly reducing the likelihood of) paintball breakage in the loader.

SUMMARY OF THE INVENTION

An impeller for an active-feed paintball loader has resilient arms that engage paintballs in the lower portion (well) of the loader and advance them to and through the outfeed tube. As used herein, the term "resilient arms" means arms that are sufficiently stiff to move unobstructed paintballs located between the arms, and sufficiently flexible to yield when forced against stationary paintballs so as not to rupture the paintball shells, the arms substantially returning to their original shape when the obstruction is removed. Accordingly, when the motor is shut off, the arms will simply flex backward as they encounter stationary paintballs. Should a paintball jam occur in the vicinity of the impeller, the arm(s) can flex around the jammed ball without breaking it, and help to dislodge it so as to clear the jam. The impeller preferably is made of a type of neoprene. It may be molded as a one-piece item, or in two mating pieces, one being a hub extension made of harder material that engages the motor shaft.

BRIEF DESCRIPTION OF THE DRAWING

Embodiments that incorporate the best mode for carrying out the invention are described below, purely by way of example, with reference to the accompanying drawing, in which.

DETAILED DESCRIPTION

Figure 1:
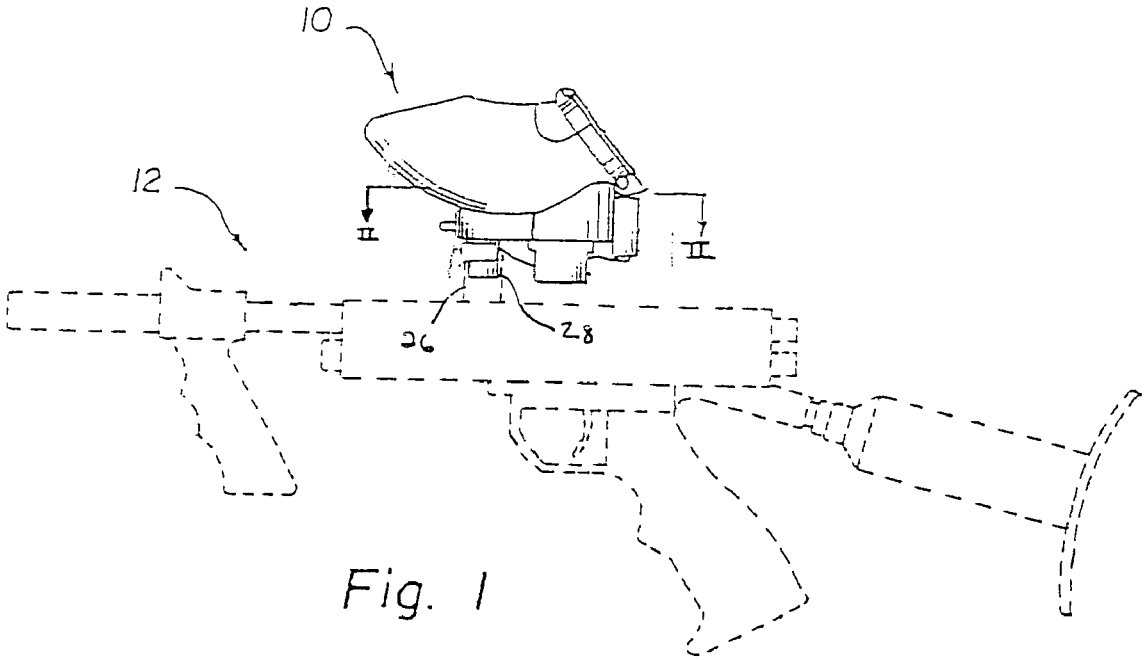
FIG. 1 is a side elevational view of a loader shown mounted on a paintball gun.

Two embodiments of the invention are illustrated in the drawing and described below. The same drawing reference numbers are used to refer to the same or like parts of these embodiments. Except as noted below, U.S. Pat. No. 5,816,232 (the '232 patent) generally depicts and describes the overall active feed paintball loader configuration used in the present invention. The differences between the present invention and the loader of the '232 patent reside in the configuration and construction of the impeller in the well at the bottom of loader that moves paintballs into and through the outfeed tube of the loader.

FIG. 1 shows a loader 10 according to the invention positioned on top of and connected to a paintball gun 12 fitted with an infeed tube 26. The outfeed tube 28 of the loader 10 mates with the infeed tube 26 of the gun 12 so that paintballs 51 housed within the loader 10 can be transferred to the gun 12 via the outfeed and infeed tubes 28, 26.

Figure 2:
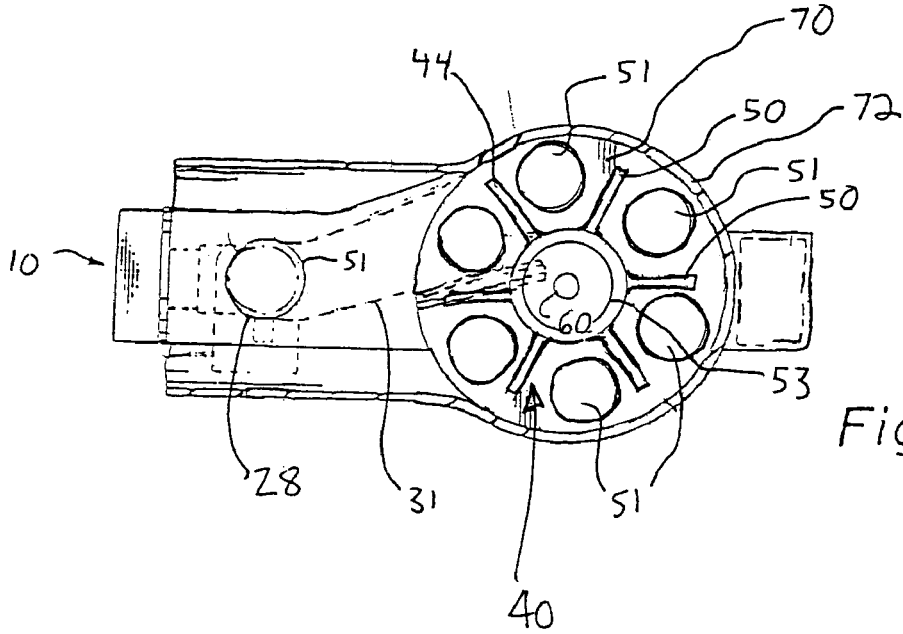
FIG. 2 is a sectional view of the loader of FIG. 1 taken along line II—II in FIG. 1.

Referring to FIG. 2, positioned within the loader 10 is an impeller 40, which is driven by a stepper motor (not shown) of the type described in the '232 patent. The impeller 40, which sits within a well 70 formed in the bottom of the loader 10, serves to force paintballs 51 into and through outfeed tube 28, which is connected to the well 70 by means of a paintball passageway 31.

Figure 3:
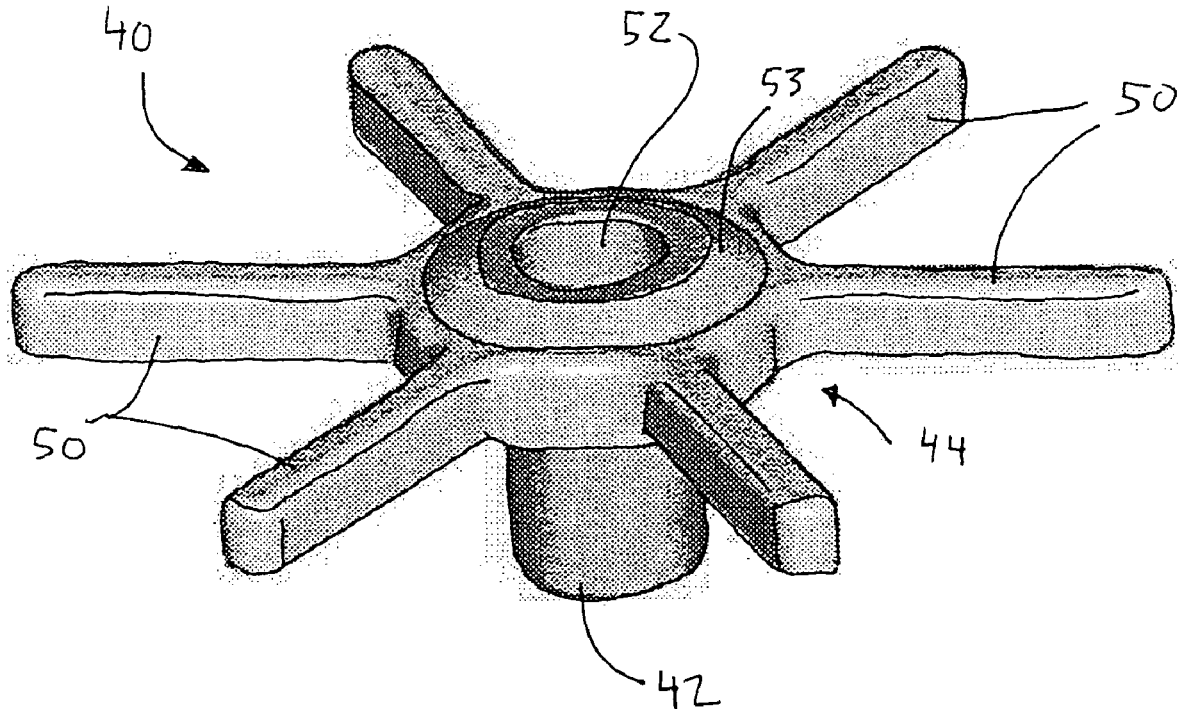
FIG. 3 is a top perspective view of a first (one-piece) embodiment of an impeller according to the invention.
Figure 4:
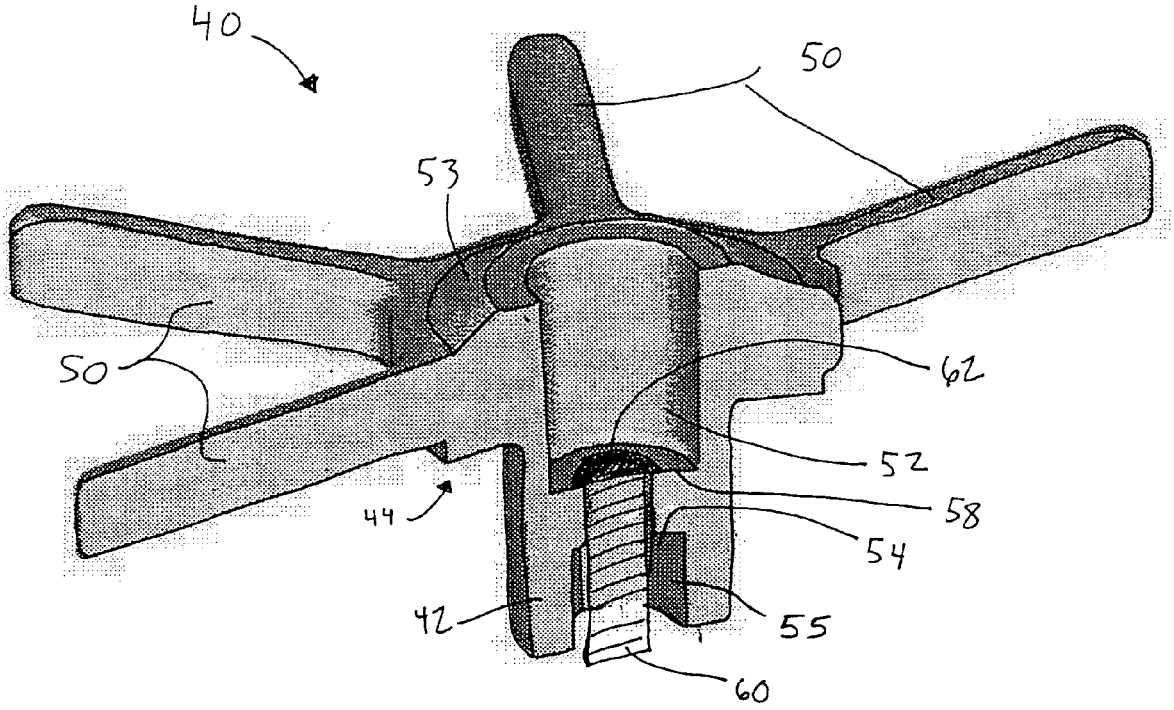
FIG. 4 is a top perspective sectional view of the one-piece impeller taken along line IV—IV in FIG. 3.
Figure 5:
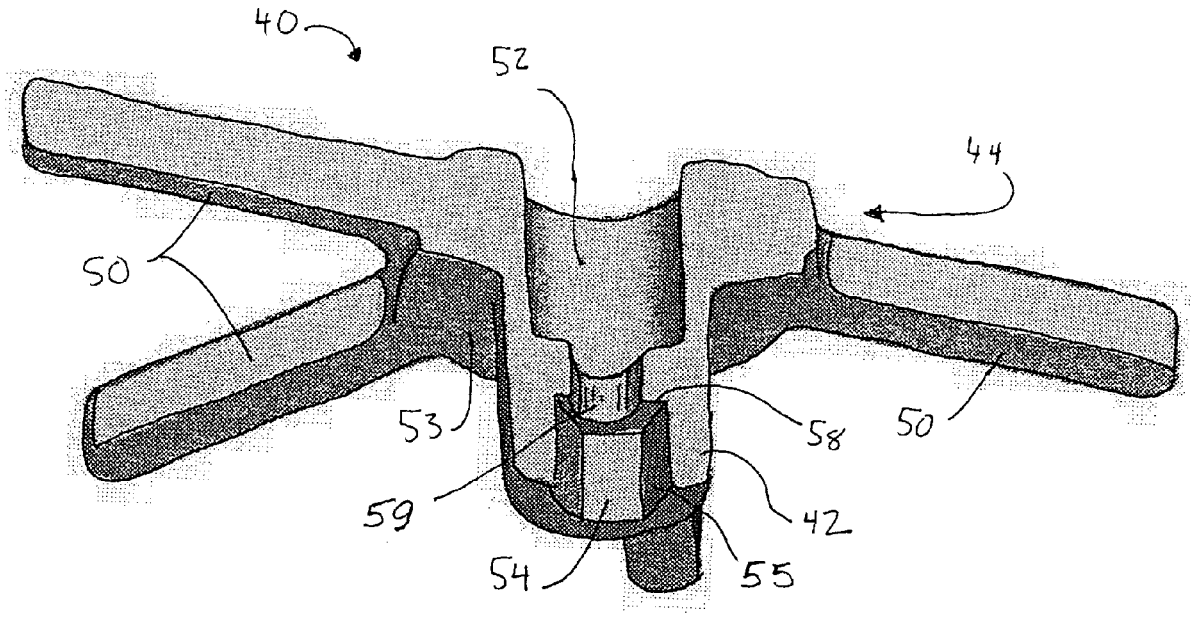
FIG. 5 is a bottom perspective sectional view of the one-piece impeller shown in FIGS. 3 and 4.

Referring to FIGS. 3–5, impeller 40 is made in one piece and includes an upper portion 44 having six equally spaced resilient arms 50 projecting from a central hub 53, and a depending hub extension 42. Hub 53 has a central bore 52. Hub extension 42 serves to mount the impeller on the vertical drive shaft of the motor. The motor is located below well 70, as described in the '232 patent. In a relaxed state, the arms 50 are substantially straight and project substantially radially from central hub 53 toward the surrounding wall 72 of the well 70. The arms 50 preferably are at a height above the bottom of the well 70 such that they engage paintballs in the well around their mid-sections, as illustrated in FIG. 3 of the '232 patent.

Hub extension 42 has a lower socket 54 in axial alignment with the central bore 52 in hub 53. Socket 54 is adapted to receive the motor drive shaft (not shown), and preferably has at least one flat 55 or other non-cylindrical portion that mates with a corresponding portion of the drive shaft so that the impeller will not slip relative to the drive shaft while the motor is running. The diameter of socket 54 preferably is smaller than the diameter of central bore 52, and a web 58 separates the socket 54 from the bore 52. Web 58 has a central hole 59 in axial alignment with socket 54 and bore 52. A suitable fastener, such as screw 60 with a head 62, is contained within impeller 40 and secures the impeller to the drive shaft.

The hub 53 of impeller 40 preferably has an outer diameter of about 19 mm. Each of the six arms preferably is about 4 mm thick, extends from the hub about 18 mm, and has slightly rounded upper edges, where paintball contact may occur. In this embodiment the entire impeller 40 is formed of a resilient material. Various types of resilient material may be used, such as rubber or plastic, provided the arms are sufficiently stiff to move unobstructed paintballs located between the arms, and sufficiently flexible to yield when forced against stationary paintballs so as not to rupture the paintball shells. Accordingly, in an over-running situation (impeller does not stop immediately upon motor shut-off), the arms will simply flex backward as they encounter stationary paintballs, the paintballs themselves serving to arrest the impeller and the flexed arms storing energy for rapid start-up when the motor is reactivated. If a paintball jam should occur in the vicinity of the impeller, the arm(s) can flex around the jammed ball and help to dislodge it so as to clear the jam. If there is a malfunction such that the motor continues to run even though the gun is not being fired, the arms will flex around the stationary paintballs, with little likelihood of breaking them.

A preferred material for injection-molding the impeller is manufactured by J-Von NA, LLC, 25 Litchfield Street, Leominster, Mass. 01453 (http://www.jvon.com). The preferred J-Von material is a type of neoprene which is marketed under the product name "J-PRENE" and is listed under product No. 5110-73A. Molding of the J-PRENE material to form impeller 40 has been accomplished by Titan Plastics Group, A.V. San Diego 610, Fracc. Indl. Nogalar, San Nicolas de los Garza, N.L., Mexico C.P. 66480. The J-PRENE material has the following properties:

| PROPERTY | ASTM TEST METHOD | UNITS | PROPERTY VALUE |
|---|---|---|---|
| Hardness, 10 sec | D-2240 | Shore A | 73 |
| Specific Gravity | D-792 | — | 0.97 |
| Melt Index Cond. G | D-1238 | g/10 min | 3 |
| Tensile Strength | D-412 | psi | 1175 |
| | | (Mpa) | (8.1) |
| TensileModulus | D-412 | psi | 480 |
| @ 100% | | (Mpa) | (3.3) |
| Ultimate Elongation | D-412 | % | 480 |
| Tear Strength | D-624 | pli | 205 |
| | | (kN/m) | (35.9) |
| Taber Abrasion | D-1044 | mg wt loss | 270 |
| Compression Set | D-395B | % @ RT 22 hrs | 22 |
| Compression Set | D-395B | % @ 70° C. 22 hrs | 34 |
| Oil Swell 24 hr, 121° C., IRM 903 | D-471 | % Volume Change | 80 |

Figure 6:
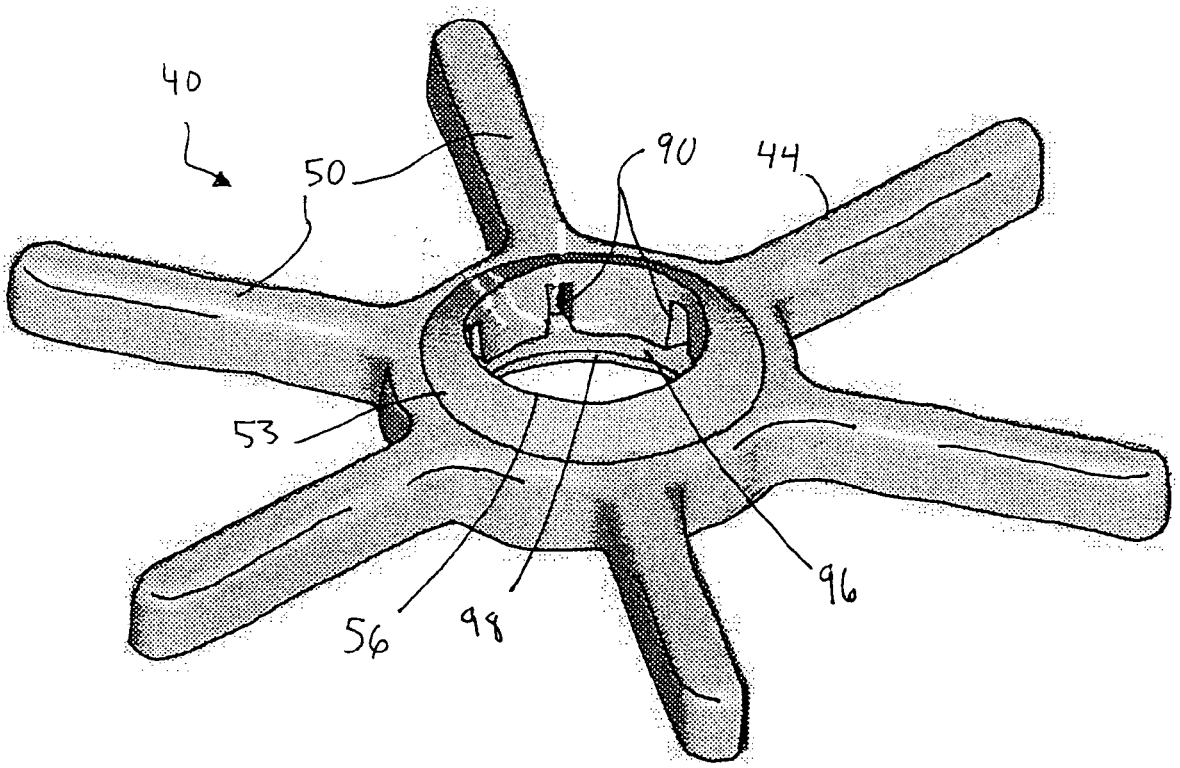
FIG. 6 is a top perspective view of the upper portion of a two-piece impeller according to a second embodiment of the invention.
Figure 7:
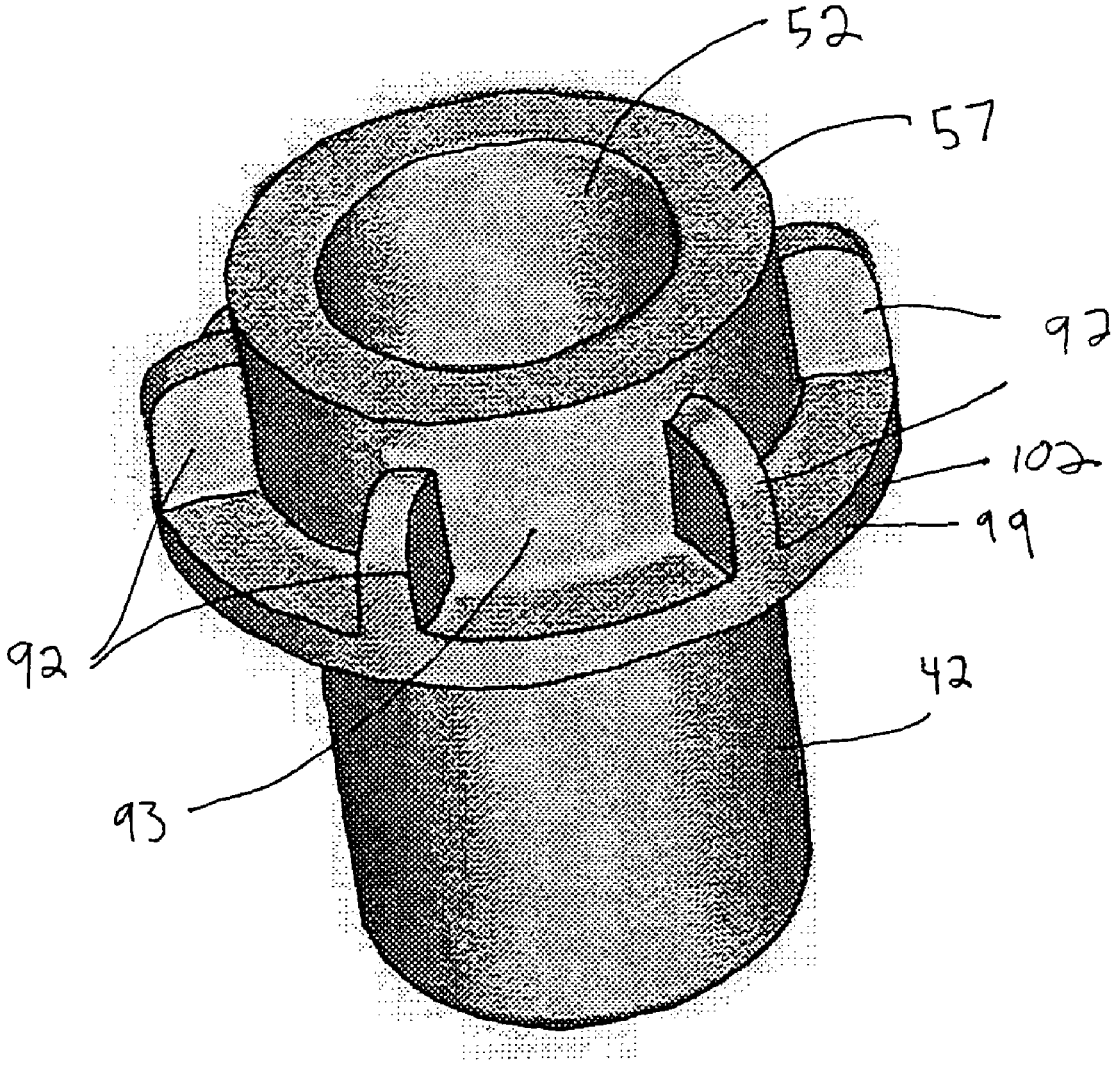
FIG. 7 is a top perspective view of the lower portion (hub insert) for the two-piece impeller shown in FIG. 6.
Figure 8:
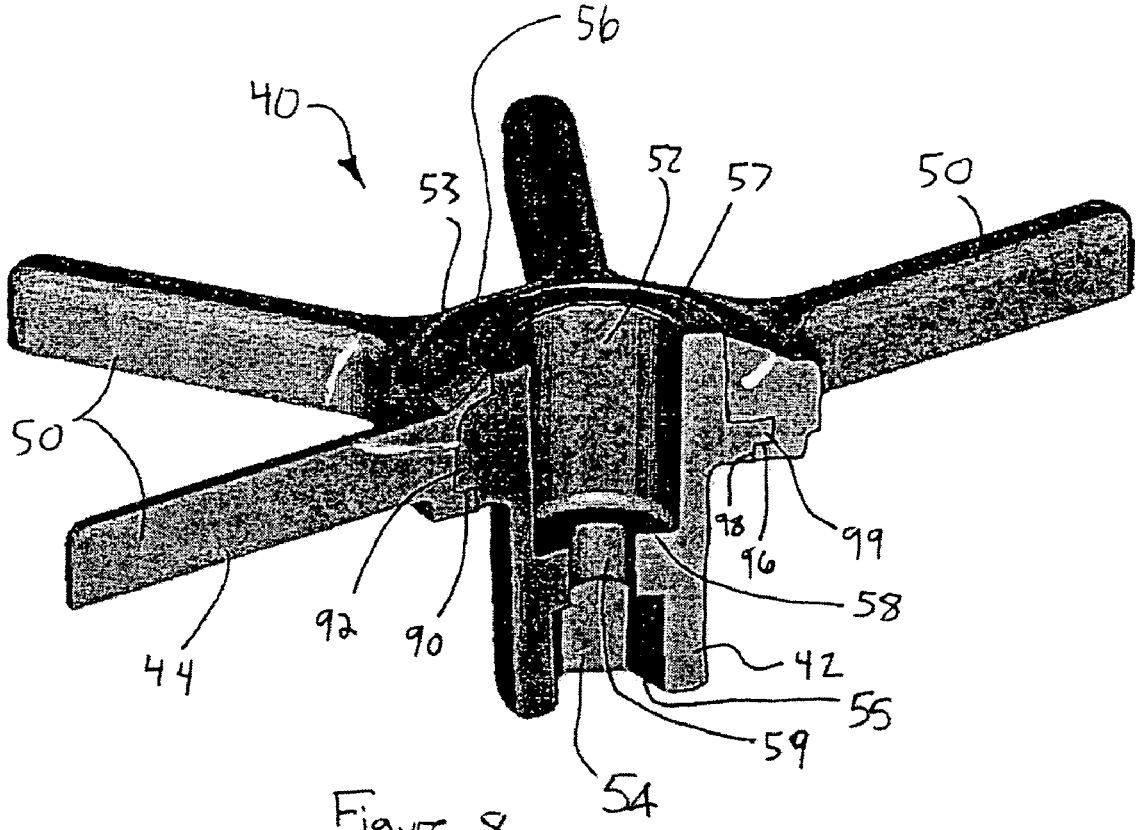
FIG. 8 is a perspective sectional view of the two-piece impeller of FIGS. 6 and 7, showing both parts engaged.

FIGS. 6–8 show a two-piece impeller 40 in which the upper portion 44 and the hub extension 42 are formed separately. In this preferred embodiment the upper portion 44, which also has a central hub 53 and radiating arms 50, preferably is formed of the same type of resilient material (e.g., J-PRENE No. 5110-73A) discussed above in connection with the one-piece embodiment. The hub extension 42, however, preferably is formed of a more rigid material, such as a hard plastic (e.g., ABS) or metal, which affords a more positive (non-slip) connection to the rotary motor shaft than the softer material used in the upper portion. The internal construction of the hub extension 42 is identical to that found in the first embodiment: a web 58 with a screw hole 59 separates a mounting socket 54 from a central bore 52. The hub extension 42 has an external geometry that mates securely with the upper portion 44 of the impeller, as described below.

Referring to FIG. 7, the hub extension 42 has a circumferential flange 99 and six equally spaced short splines 92 having rounded corners. The splines 92 project upwardly from flange 99 and radially from the upper outer wall 93 of a boss 57 at the upper end of the hub extension. Mating recesses in the upper portion 44 of the impeller snugly receive these projections to form a secure connection between the two parts. Referring to FIGS. 6 and 8, a bore 56 in upper portion 44 receives boss 57 of hub extension 42; six circumferentially spaced notches 90 in upper portion 44 receive splines 92; and a lip 98 forms a circumferential groove 96 that receives flange 99.

Upper portion 44 preferably is over-molded onto hub extension 42, which is inserted in the mold for upper portion 44 prior to injection of the J-PRENE or other resilient material. This will result in a very snug fit of the two parts. It is also possible to mold upper portion 44 separately, and later join it to hub extension 42. This would be accomplished by placing the bore 56 over the boss 57 with the notches 90 in alignment with the splines 92. The upper portion 44 is then flexed, stretched and pressed down over boss 57 until lip 98 is positioned below flange 99, with flange 99 snugly received in groove 96, splines 92 snugly received in notches 90, and boss 57 snugly received in bore 56.

Although preferred embodiments of the invention have been described, the invention is not so restricted. It will be apparent to those skilled in the art that various modifications and variations can be made without departing from the scope of the invention, which is defined by the appended claims. For example, the impeller can have fewer or more than the illustrated six arms as long as a paintball can fit between adjacent arms and a desired paintball feed rate can be maintained. Accordingly, it should be understood that the apparatus and methods described herein are illustrative only and are not limiting upon the scope of the invention.

The invention claimed is:

1. An impeller for an active feed paintball loader, the loader having a housing for storing paintballs, a bottom well in the housing with a paintball outlet, and a motor-driven shaft projecting upwardly into the well; wherein the impeller comprises a hub adapted to be mounted on and rotate with the shaft in the well, and a plurality of resilient arms extending outwardly from the hub and accommodating paintballs therebetween, and wherein the hub has an upper portion from which the arms extend, and a separate lower hub extension adapted to be mounted on the shaft, the upper portion and the lower hub extension being configured to mate with each other and not rotate relative to one another.

2. An impeller according to claim 1, wherein the upper portion of the hub and the arms are integrally formed of a first material, and the hub extension is formed of a second material that is more rigid than the first material.

3. An impeller according to claim 2, wherein the first material is neoprene.

4. An impeller according to claim 1, wherein the arms are substantially straight.

5. An impeller according to claim 4, wherein the arms project substantially radially from the hub.

6. An impeller according to claim 5, wherein the upper portion of the hub and the arms are integrally formed of a first material, and the hub extension is formed of a second material that is more rigid than the first material.

7. An impeller according to claim 6, wherein the first material is neoprene.

8. An impeller according to claim 1, wherein one of the upper portion of the hub and the hub extension has projections, and the other of the upper portion of the hub and the hub extension has recesses that mate with the projections.

9. An impeller according to claim 8, wherein the projections comprise splines.

10. An impeller according to claim 9, wherein the splines are on the hub extension, and the recesses are on the upper portion of the hub.

11. An impeller according to claim 10, wherein the projections further comprise a circumferential flange on the hub extension, and the recesses comprise a circumferential groove on the upper portion of the hub that mates with the circumferential flange.

12. An impeller according to claim 11, wherein the upper portion of the hub and the arms are integrally formed of a first material, and the hub extension is formed of a second material that is more rigid than the first material.

13. An impeller according to claim 12, wherein the first material is neoprene.

14. An impeller according to claim 13, wherein the arms are substantially straight.

15. An impeller according to claim 14, wherein the arms project substantially radially from the hub.

16. An active feed paintball loader comprising a housing for storing paintballs, a bottom well in the housing with a paintball outlet, a rotatable shaft projecting upwardly into the well, a motor for driving the shaft, and an impeller in the well mounted on and rotatable with the shaft for moving paintballs toward the outlet, wherein the impeller comprises:

a hub mounted on and rotatable with the shaft; and a plurality of resilient arms extending outwardly from the hub and accommodating paintballs therebetween.

17. An active feed paintball loader according to claim 16, wherein the arms are substantially straight.

18. An active feed paintball loader according to claim 17, wherein the arms project substantially radially from the hub.

19. An active feed paintball loader according to claim 18, wherein the impeller is made of neoprene.

20. An active feed paintball loader according to claim 19, wherein the hub and the arms are integrally molded.

21. An active feed paintball loader according to claim 18, wherein the hub and the arms are integrally molded.

22. An active feed paintball loader according to claim 16, wherein the hub and the arms are integrally molded.

23. An active feed paintball loader according to claim 22, wherein the impeller is made of neoprene.

24. An active feed paintball loader according to claim 16, wherein the hub has an upper portion from which the arms extend, and a separate lower hub extension adapted to be mounted on the shaft, the upper portion and the lower hub extension being configured to mate with each other and not rotate relative to one another.

25. An active feed paintball loader according to claim 24, wherein the upper portion of the hub and the arms are integrally formed of a first material, and the hub extension is formed of a second material that is more rigid than the first material.

26. An active feed paintball loader according to claim 25, wherein the first material is neoprene.

27. An active feed paintball loader according to claim 24, wherein the arms are substantially straight.

28. An active feed paintball loader according to claim 27, wherein the arms project substantially radially from the hub.

29. An active feed paintball loader according to claim 28, wherein the upper portion of the hub and the arms are integrally formed of a first material, and the hub extension is formed of a second material that is more rigid than the first material.

30. An active feed paintball loader according to claim 29, wherein the first material is neoprene.

31. An active feed paintball loader according to claim 24, wherein one of the upper portion of the hub and the hub extension has projections, and the other of the upper portion of the hub and the hub extension has recesses that mate with the projections.

32. An active feed paintball loader according to claim 31, wherein the projections comprise splines.

33. An active feed paintball loader according to claim 32, wherein the splines are on the hub extension, and the recesses are on the upper portion of the hub.

34. An active feed paintball loader according to claim 33, wherein the projections further comprise a circumferential flange on the hub extension, and the recesses comprise a circumferential groove on the upper portion of the hub that mates with the circumferential flange.

35. An active feed paintball loader according to claim 34, wherein the upper portion of the hub and the arms are integrally formed of a first material, and the hub extension is formed of a second material that is more rigid than the first material.

36. An active feed paintball loader according to claim 35, wherein the first material is neoprene.

37. An active feed paintball loader according to claim 36, wherein the arms are substantially straight.

38. An active feed paintball loader according to claim 37, wherein the arms project substantially radially from the hub.

39. An impeller comprising:

a hub; and a plurality of resilient arms extending outwardly from the hub, wherein the impeller is configured for placement in an active feed paintball loader, the loader having a housing for storing paintballs, a bottom well in the housing with a paintball outlet through which the impeller pushes paintballs, and a motor-driven shaft projecting upwardly into the well, wherein the hub is configured to be mounted on and rotate with the shaft in the well, and the arms are sized to fit within the well and are spaced to accommodate paintballs therebetween, and wherein the hub has an upper portion from which the arms extend, and a separate lower hub extension adapted to be mounted on the shaft, the upper portion and the lower hub extension being configured to mate with each other and not rotate relative to one another.

40. An impeller according to claim 39, wherein the arms are substantially straight.

41. An impeller according to claim 40, wherein the arms project substantially radially from the hub.

42. An impeller according to claim 41, wherein the impeller is made of neoprene.

43. An impeller according to claim 42, wherein the hub and the arms are integrally molded.

44. An impeller according to claim 41, wherein the hub and the arms are integrally molded.

45. An impeller according to claim 39, wherein the hub and the arms are integrally molded.

46. An impeller according to claim 45, wherein the impeller is made of neoprene.

47. An impeller according to claim 39, wherein the upper portion of the hub and the arms are integrally formed of a first material, and the hub extension is formed of a second material that is more rigid than the first material.

48. An impeller according to claim 47, wherein the first material is neoprene.

49. An impeller according to claim 39, wherein one of the upper portion of the hub and the hub extension has projections, and the other of the upper portion of the hub and the hub extension has recesses that mate with the projections.

50. An impeller according to claim 49, wherein the projections comprise splines.

51. An impeller according to claim 50, wherein the splines are on the hub extension, and the recesses are on the upper portion of the hub.

52. An impeller according to claim 51, wherein the projections further comprise a circumferential flange on the hub extension, and the recesses comprise a circumferential groove on the upper portion of the hub that mates with the circumferential flange.

* * * * *